US006042484A

United States Patent [19]

Streit

[11] Patent Number: 6,042,484

[45] Date of Patent: Mar. 28, 2000

[54] GOLF CLUB IDENTIFICATION DEVICE

[76] Inventor: Kenneth F. Streit, 414 S. Seegwun Ave., Mt. Prospect, Ill. 60056

[21] Appl. No.: 09/019,269

[22] Filed: Feb. 5, 1998

[51] Int. Cl.[7] ..... A63B 57/00

[52] U.S. Cl. ..... 473/282; 40/317; 40/660; 40/915

[58] Field of Search ..... 473/282, 316; 40/317, 660, 915

[56] References Cited

U.S. PATENT DOCUMENTS

| | | | |
|---|---|---|---|
| 436,799 | 9/1890 | McLaughin | 40/317 |
| 926,483 | 6/1909 | Groby | 40/317 |
| 990,059 | 4/1911 | Masko . | |
| 1,346,810 | 7/1920 | Decker | 40/658 |
| 1,563,039 | 11/1925 | Newell . | |
| 1,766,454 | 6/1930 | Rawley . | |
| 1,779,496 | 10/1930 | Scott . | |
| 1,830,936 | 11/1931 | Faith . | |
| 2,154,989 | 4/1939 | Moore . | |
| 2,612,373 | 9/1952 | Pierce . | |
| 4,017,082 | 4/1977 | Channing et al. . | |
| 4,822,052 | 4/1989 | Dimmick et al. . | |
| 5,145,171 | 9/1992 | Head | 473/300 |
| 5,187,887 | 2/1993 | Mori et al. . | |
| 5,458,931 | 10/1995 | Mankes | 428/14 |

*Primary Examiner*—Jeanette Chapman
*Assistant Examiner*—Stephen L. Blau
*Attorney, Agent, or Firm*—Pauley Petersen Kinne & Fejer

[57] ABSTRACT

A golf club identification device for engagement with a golf club grip and a golf club shaft. A tubular element having a longitudinal slot engages the golf club shaft through the slot. A flange, integrally formed with respect to the tubular element, engages with the golf club grip. A label containing printed identification information may then be inserted within the tubular element or positioned on the tubular element. A lens may also be added to the tubular element to position and/or protect the label.

17 Claims, 4 Drawing Sheets

GOLF CLUB IDENTIFICATION DEVICE

BACKGROUND OF THE INVENTION

1. Field of the Invention

This invention relates to a golf club identification device for conspicuously designating ownership of individual golf clubs.

2. Description of the Prior Art

Golf is a popular sport and hobby throughout the world. Golf equipment, specifically golf clubs, can be expensive to purchase and replace. Because of the dominance of several major manufacturers, one golfer's golf clubs may be completely indistinguishable, absent any identifying marks, from the golf clubs of another golfer. Adding to this potential confusion is the common occurrence of golfers forgetting or dropping individual golf clubs at a prior green, tee box, or warm-up area. Therefore, a need is recognized to identify individual golf clubs by owner to facilitate return of misplaced, dropped or stolen golf clubs.

A common means of identifying golf clubs is a simple adhesive label, such as an envelope address label. Such labels are wrapped around a portion of the golf club shaft or golf club grip. These labels must typically be replaced on an annual or more frequent basis because they tear, become wet and fall off, or become dirty and obscured. Such labels also may cheapen the appearance of a golf club and, upon repeated replacement, may add a sticky film to the golf club shaft.

Faith, U.S. Pat. No. 1,830,936, and Dimmick et al., U.S. Pat. No. 4,822,052, each disclose a golf club identification marker that attaches to a golf club grip. The Faith patent and the Dimmick et al. patent teach a disc-like body portion having an imprinted means of identification connected with respect to a cylindrical anchor member. The cylindrical anchor member is inserted into an aperture in the knob at the top of the golf club grip.

Masko, U.S. Pat. No. 990,059, and Newell, U.S. Pat. No. 1,563,039, each disclose an umbrella identification system comprising a sleeve that slides over an umbrella rod. The Newell patent teaches a sleeve having a guide flange forming a series of spikes that are driven into the umbrella handle.

Pierce, U.S. Pat. No. 2,612,373, teaches a golf tee that wraps around a golf club shaft or golf club grip. The golf tee taught by the Pierce patent comprises a gapped tube of a suitable diameter for clasping the golf club shaft or golf club grip.

SUMMARY OF THE INVENTION

It is one object of this invention to provide a golf club identification device that is durable and inexpensive.

It is another object of this invention to provide a golf club identification device that blends in with the appearance of the golf club and yet still provides conspicuous identification.

It is a further object of this invention to provide a golf club identification device that functions with a wide variety of golf clubs.

It is still another object of this invention to provide a golf club identification device that is readily transferable from one set of golf clubs to a replacement set of golf clubs.

A golf club identification device for engagement with a golf club grip and a golf club shaft preferably comprises a tubular element having a portion of material removed to define a slot. The tubular element preferably engages with the golf club shaft, the slot passing over the golf club shaft. Further, a tubular flange is preferably integrally formed with respect to the tubular element.

The flange preferably engages with the golf club grip around a circumference of the golf club shaft. The golf club grip preferably rolls or folds upward so that the flange slides underneath an end of the golf club grip between the golf club grip and the golf club shaft. A shoulder, such as a raised circumferential ridge, may be positioned between the tubular element and the flange for indexing insertion of the flange into the golf club grip. Alternatively, the flange may be glued or otherwise affixed with respect to a lower portion of the golf club grip and/or an upper portion of the golf club shaft.

The golf club identification device provides a medium for actual identification of a golf club. Therefore the tubular element may be physically printed with identification information or, alternatively, a label may be positioned with respect to the tubular element. The label, which is preferably printed with identification information, may be adhesive-bonded to the tubular element or retained by the geometry of the golf club identification device.

The golf club identification device may be constructed of a clear material so that the label is legible when positioned inside the tubular element. In this embodiment of the invention, the label may be adhered to an inner surface of the tubular element or inserted into the tubular element and retained with ridges positioned adjacent each side of the slot. The ridges retain the label within the tubular element when the label is inserted into the slot and around the circumference of the golf club shaft.

In another preferred embodiment of this invention, the golf club identification device may additionally include a lens, preferably transparent, that surrounds at least a portion of the tubular element. The lens thereby protects the label yet still maintains legibility.

The above embodiments of this invention preferably involve situations where the golf club identification device is connected with respect to a lower portion of the golf club grip. However, other means of attachment to the golf club grip may be required by the configuration of the golf club grip. In those circumstances requiring an alternate embodiment of the invention, the golf club identification device preferably comprises a printed identification element having one or more integral flanges. In this preferred embodiment of the invention, the identification element is inserted into an opening formed within the golf club grip and the flanges are inserted into adjacent portions of the remaining golf club grip.

BRIEF DESCRIPTION OF THE DRAWINGS

The above-mentioned and other features and objects of this invention will be better understood from the following detailed description taken in conjunction with the drawings wherein.

DESCRIPTION OF THE PREFERRED EMBODIMENTS

Golf club identification device 5 for engagement with a golf club grip and a golf club shaft is shown in FIGS. 1–3 and 5–8. Golf club identification device 5 is preferably constructed from a polymeric material, preferably exhibiting rigidity with a small amount of flexibility, such as nylon, acrylic, polystyrene, polypropylene or similar suitable resin.

Figure 1:
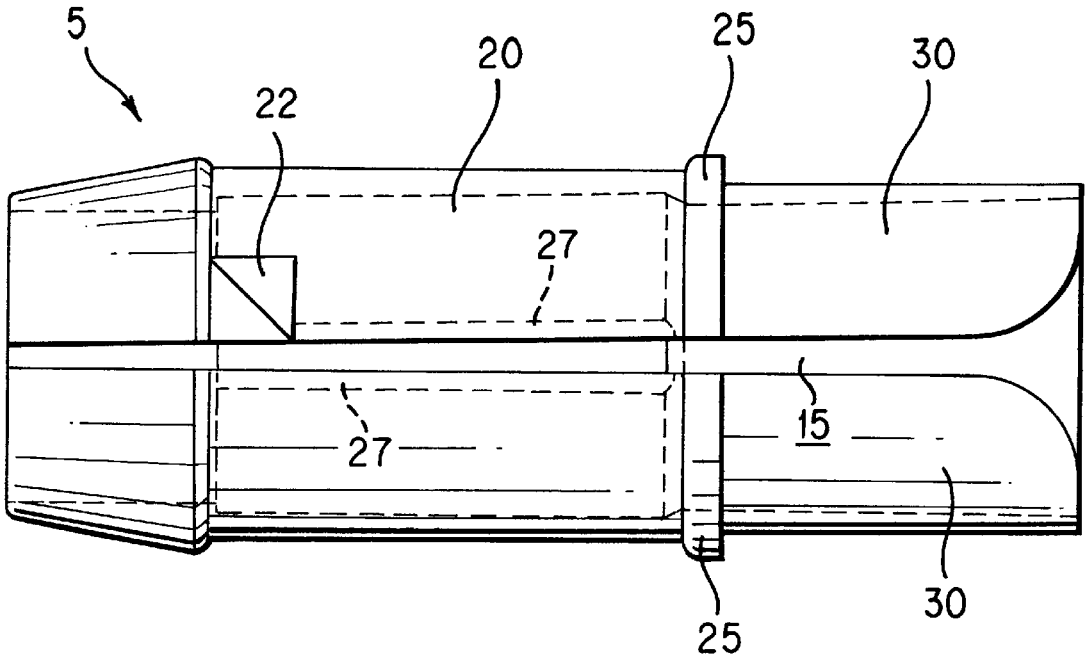
FIG. 1 is a side view of the golf club identification device according to one preferred embodiment of this invention.
Figure 2:
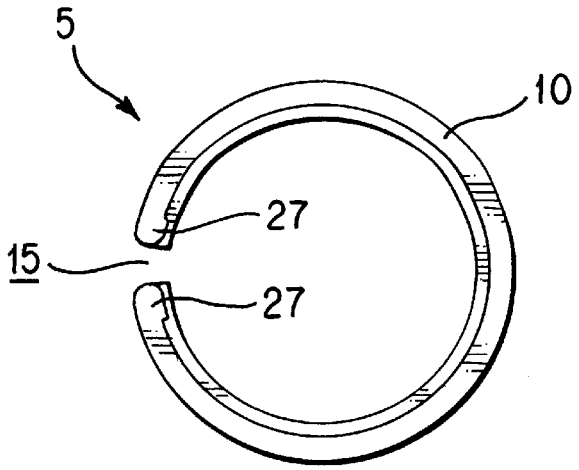
FIG. 2 is a section view through a center area of the golf club identification device shown in FIG. 1.
Figure 3:
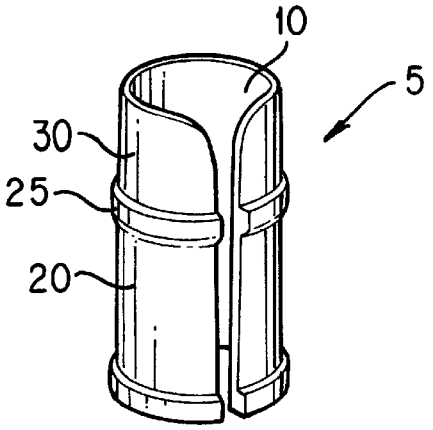
FIG. 3 is a perspective view of a golf club identification device according to one preferred embodiment of this invention.
Figure 5A:
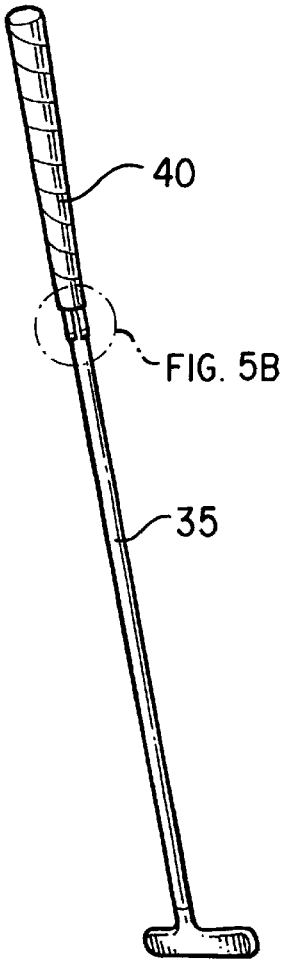
FIG. 5A is a diagrammatic side view of a golf club together with a golf club identification device according to one preferred embodiment of this invention.
Figure 5B:
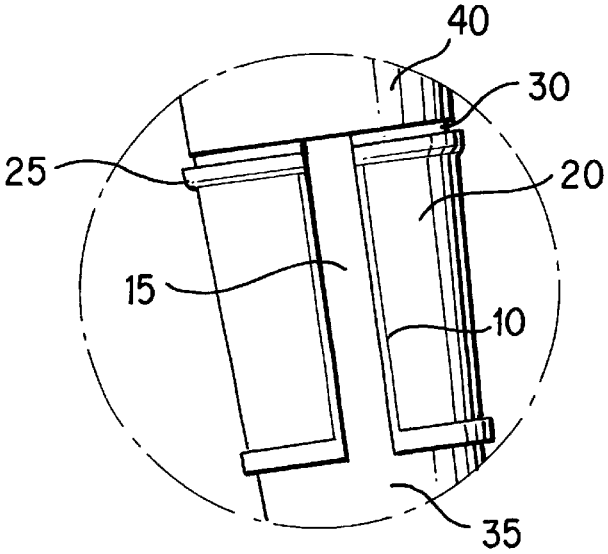
FIG. 5B is a close-up diagrammatic side view of the golf club shown in FIG. 5A together with the golf club identification device.

As shown in FIGS. 1–3, golf club identification device 5 comprises tubular element 10 having a portion of material removed to define slot 15. Slot 15 is sized so that golf club shaft 35, shown in FIGS. 5A and 5B, will fit through slot 15, preferably when tubular element 10 is outwardly tensioned so that slot 15 becomes temporarily wider. Tubular element 10 thereby engages with golf club shaft 35, preferably as shown in FIGS. 5A and 5B, so that golf club shaft 35 passes through tubular element 10.

In one preferred embodiment of this invention, tubular element 10 further comprises label housing 20 integral with at least a partial perimeter of tubular element 20. Label housing 20 preferably is a recessed area within tubular element 10. Alternatively, label housing 20 may comprise a raised area on tubular element 10. Preferably, label housing 20 should accommodate label 22 or directly support printed identification information.

Figure 7:
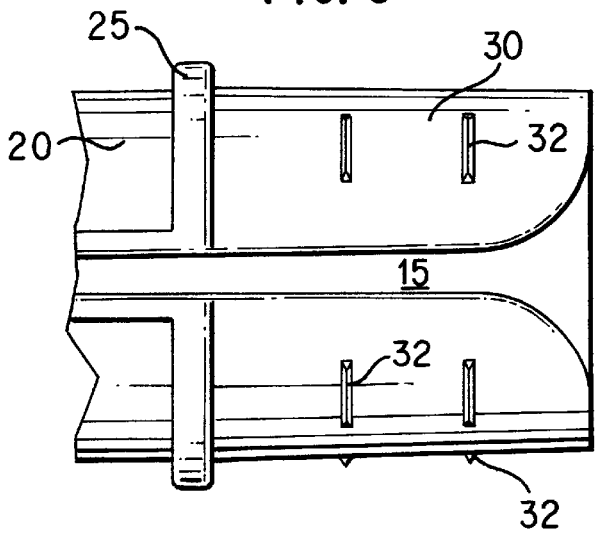
FIG. 7 is a side view of one preferred embodiment of a flange on the golf club identification device.

Golf club identification device 5 also preferably includes flange 30 as shown in FIGS. 1, 3 and 7. Flange 30 is preferably integrally formed with respect to tubular element 10. Flange 30 is preferably, though not necessarily, defined by a portion of tubular element 10 having a reduced thickness and/or diameter from the balance of tubular element 10.

In one preferred embodiment of this invention, flange 30 is tubular and engages with golf club grip 40 around a circumference of golf club shaft 35. Golf club grips 40, such as shown in FIGS. 5A and 5B, are typically rubber or leather strips or sleeves that wrap around golf club shaft 40, extending from a top of golf club shaft 40 for approximately one-quarter to one-third of the length of golf club shaft 40. Golf club grip 40 preferably rolls or folds upward at an interface between an end of golf club grip 40 and golf club shaft 35. Flange 30 preferably slides underneath the end of golf club grip 40 so that inward circumferential tension of golf club grip 40 maintains position of golf club identification device 5 along golf club shaft 35. Alternatively, flange 30 may be glued, banded, taped or otherwise affixed with respect to a lower portion of golf club grip 40 and/or an upper portion of golf club shaft 35.

Figure 8:
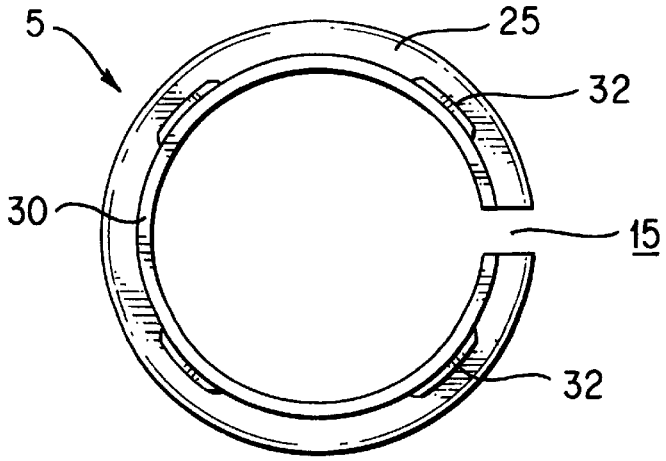
FIG. 8 is an end view of the radial flange shown in FIG. 7.

In one preferred embodiment of this invention, shown in FIGS. 7 and 8, flange 30 includes ribs 32, knobs or other projections. Preferably, ribs 32 are intermittently-spaced projections that help secure flange 30 with respect to golf club grip 40 by providing additional frictional engagement between additional surface area of ribs 32 on flange 30 and golf club grip 40.

In one preferred embodiment of this invention, golf club identification device 5 further comprises shoulder 25 separating at least a portion of flange 30 from tubular element 10. Shoulder 25 preferably comprises a raised area extending circumferentially around at least a portion of tubular element 10. Shoulder 25 preferably abuts golf club grip 40 when golf club identification device 5 is in a fully installed position. Therefore, shoulder 25 provides an indication of how far flange 30 should be inserted into golf club grip 40 to secure golf club identification device 5 with respect to the golf club.

In another preferred embodiment of this invention, shoulder 25 also extends inwardly so that a raised area extends at least partially around an internal circumference of tubular element 10.

As thus far described, golf club identification device 5 provides a medium for some form of actual identification, such as name, address and telephone number. In one preferred embodiment of this invention, tubular element 10 is physically stamped or printed with identification information. Tubular element 10 may be silk screened, hot stamped or marked using other means of labeling thermoplastic components known to those having ordinary skill in the art.

In another preferred embodiment of this invention, shown in FIG. 1, label 22 is applied to tubular element 10. Label 22, also printed with identification information, may be loosely inserted or attached by self-stick adhesive or other adhesion means, such as glue or tape, to adhere label 22 to tubular element 10. Label 22 is preferably constructed from a water-resistant and tear-resistant material such as coated paper or plastic film.

In another preferred embodiment of this invention, golf club identification device 5 is constructed entirely of a transparent material such as nylon, acrylic, polystyrene, polypropylene or other suitable resin. In this preferred embodiment of the invention, label 22 is preferably freely positioned in an internal portion of tubular element 10.

Label 22 may be adhered to an inner surface of tubular element 10 with adhesive so that the identification information is visible through the transparent material in tubular element 10. Alternatively, label 22 may be inserted into tubular element 10 and maintain position through the internal geometry of tubular element 10.

Figure 6:
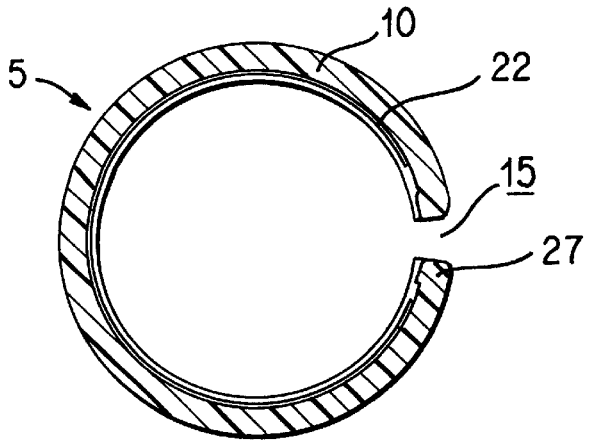
FIG. 6 is a cross-sectional view of a golf club identification device according to one preferred embodiment of this invention.

In this preferred embodiment of the invention, shown in FIGS. 1, 2 and 6, the internal geometry of tubular element 10 preferably includes at least one ridge 27 positioned with respect to at least one interior edge of tubular element 10. Preferably, ridge 27 is positioned in an internal portion of tubular element 10 adjacent each side of slot 15. Although possible, ridge 27 preferably does not fully extend inward radially to contact golf club shaft 35.

As shown in FIG. 6, label 22 is inserted into slot 15 in tubular element 10. When label 22 is fully inserted within tubular element 10, ridge 27 positioned on each side of slot 15 retains label 22 in a seated position fully within tubular element 10. Shoulder 25 may also extend inwardly toward golf club shaft 35, also helping seat label 22 fully within tubular element 10.

Figure 4:
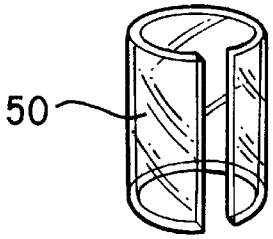
FIG. 4 is a perspective view of a lens for use with the golf club identification device shown in FIG. 3.

In another preferred embodiment of this invention, golf club identification device 5 further comprises lens 50 shown in FIG. 4. Lens 50 is preferably constructed from a transparent material, such as acrylic or polypropylene. Lens 50 preferably engages at least a portion of a circumference of tubular element 10. Lens 50 may snap into tubular element 10 using tabs or flanges (not shown) or frictionally engage a circumference of tubular element 10.

Lens 50 may be placed over tubular element 10 having label 22 applied to tubular element 10. Alternatively, label 22 may be applied to an inner surface of lens 50 prior to placement on tubular element 10. Additionally, lens 50 may have silk-screened, hot-stamped or other pre-printed identification information.

The above embodiments of this invention preferably involve embodiments wherein golf club identification device 5 is connected with respect to a lower portion of golf club grip 40 and/or the interface between a bottom of golf club grip 40 and golf club shaft 40. However, in some applications of golf club identification device 5, other means of attachment to golf club grip 40 may be required by the configuration of golf club grip 40. For instance, the lower portion of golf club grip 40 may be affixed with tape or otherwise to golf club shaft 35 or golf club grip may be integrally formed with golf club shaft 35.

Figure 9:
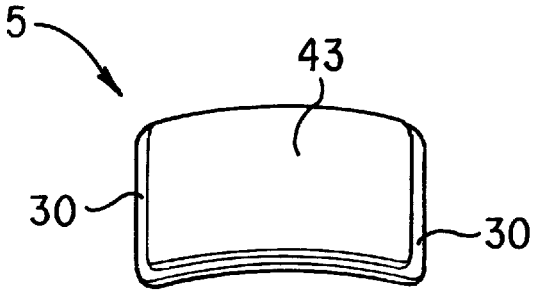
FIG. 9 is a side view of a golf club identification device according to one preferred embodiment of the invention.

In those circumstances requiring an alternate embodiment of the invention, golf club identification device 5 preferably comprises identification element 43 having one or more flanges 30 integrally formed with respect to identification element 43, such as shown in FIG. 9. In this preferred embodiment of the invention, identification element 43 is preferably generally planar or gently curved but not tubular as in the preferred embodiment described above.

Figure 10:
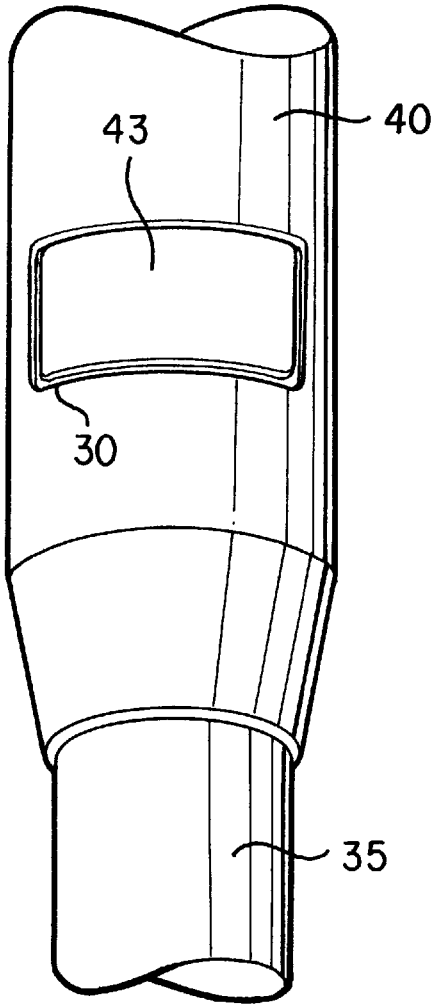
FIG. 10 is a diagrammatic side view of a golf club grip together with a golf club identification device according to a preferred embodiment of the invention.

In this preferred embodiment of the invention, a portion of golf club grip 40 is removed to create an opening within golf club grip 40 to preferably expose golf club shaft 35. As shown in FIG. 10, identification element 43 is placed into the opening and each flange 30 is preferably tucked underneath golf club grip 40 or is otherwise affixed within the recess of golf club grip 40. Preferably, flanges 30 are positioned along at least two opposite edges of printed identification element 43. In this manner, golf club identification device is preferably integrated with golf club grip 40 such that corresponding exposed surfaces of golf club grip 40 and identification element 43 are substantially flush with respect to each other. The flush engagement of identification element 43 with respect to golf club grip 40 is important so as to not interfere with the position of a golfer's hands and fingers on golf club grip 40.

In this preferred embodiment of the invention, identification element 43 may be pre-printed or a label may be positioned with respect to identification element 43. The label may be adhesive and/or loosely positioned between a transparent embodiment of identification element 43 and golf club shaft 35. Alternatively, golf club identification device 5 may further comprise a lens (not shown) that engages and at least partially covers printed identification element 43.

While in the foregoing specification this invention has been described in relation to certain preferred embodiments thereof, and many details have been set forth for purposes of illustration, it will be apparent to those skilled in the art that the apparatus is susceptible to additional embodiments and that certain of the details described herein can be varied considerably without departing from the basic principles of the invention.

I claim:

1. A golf club identification device for engagement with a golf club grip and a golf club shaft, the golf club identification device comprising:

a tubular element having a portion of material removed to define a slot extending an entire longitudinal length of the tubular element, the tubular element for engaging with the golf club shaft; and a flange associated with the tubular element, the flange having a plurality of ribs for engaging with the golf club grip wherein at least a portion of the flange is for sliding underneath the golf club grip.

2. The golf club identification device of claim 1 further comprising at least one ridge positioned immediately adjacent to the slot along an interior edge of the tubular element.

3. A golf club identification device for engagement with a golf club grip and a golf club shaft, the golf club identification device comprising:

a tubular element having a portion of material removed to define a slot extending an entire longitudinal length of the tubular element, the tubular element for surrounding a portion of the golf club shaft;

a label housing integral with at least a part of the tubular element;

a flange integrally formed with respect to the tubular element, the flange having a plurality of ribs and separated from the label housing element by a shoulder; and at least a portion of the flange for engaging with the golf club grip wherein at least a portion of the flange is for sliding underneath the golf club grip.

4. The golf club identification device of claim 3 further comprising a printed identification label positioned with respect to the label housing.

5. The golf club identification device of claim 3 further comprising a lens engaging the tubular element and covering at least a portion of the label housing.

6. A golf club identification device for engagement with a golf club grip and a golf club shaft, the golf club identification device comprising:

a tubular element having a portion of material removed to define a slot, the tubular element for surrounding a portion of the golf club shaft;

a label housing integral with at least a part of the tubular element;

a flange integrally formed with respect to the tubular element, the flange separated from the label housing element by a shoulder;

at least a portion of the flange for engaging with the golf club grip wherein at least a portion of the flange is for sliding underneath the golf club grip; and a ridge positioned immediately adjacent to each side of the slot in an internal portion of the tubular element.

7. The golf club identification device of claim 6 wherein the flange further includes a plurality of ribs.

8. A golf club identification device for engagement with a golf club, the golf club identification device comprising:

a tubular element having a portion of material removed to define a slot extending along an entire longitudinal length of the tubular element;

a flange having a plurality of ribs, the flange associated with the tubular element and for engaging with the golf club wherein at least a portion of the flange is for sliding underneath a golf club grip.

9. The golf club identification device of claim 8 wherein a label is positioned with respect to an inner surface of the tubular element.

10. A golf club identification device for engagement with a golf club, the golf club identification device comprising:

a tubular element having a portion of material removed to define a slot, the tubular element for engaging with a shaft of the golf club wherein at least a portion of the tubular element is for sliding underneath a golf club grip; and at least one ridge positioned immediately adjacent to the slot in an internal portion of the tubular element.

11. The golf club identification device of claim 10 comprising two of the ridges.

12. The golf club identification device of claim 1 further comprising a shoulder separating at least a portion of the flange from the tubular element.

13. The golf club identification device of claim 10 wherein the tubular element is printed with identification information.

14. The golf club identification device of claim 10 further comprising a label applied to the tubular element, the label imprinted with identification information.

15. The golf club identification device of claim 10 further comprising a lens associated with at least a portion of the tubular element.

16. The golf club identification device of claim 15 wherein the lens contains printed identification information.

17. The golf club identification device of claim 15 wherein the lens further comprises a printed information label positioned with respect to an inside surface of the lens.

* * * * *